US006468588B1

(12) United States Patent
Bernert et al.

(10) Patent No.: US 6,468,588 B1
(45) **Date of Patent: *Oct. 22, 2002**

(54) APPARATUS AND METHOD FOR APPLICATION OF A LIQUID OR PASTY MEDIUM ONTO A PASSING SUBSTRATE

(75) Inventors: Richard Bernert, Giengen (DE); Michael Trefz, Appleton, WI (US); Harald Hess, Grünkraut (DE)

(73) Assignee: Voith Sulzer Papiermaschinen GmbH, Heidenheim (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/076,247

(22) Filed: May 12, 1998

(51) Int. Cl.[7] ..... B05D 3/12

(52) U.S. Cl. ..... 427/356; 118/261; 118/413; 118/419; 118/206; 118/304; 427/361

(58) Field of Search ..... 427/8, 356, 358, 427/359, 361, 364, 424, 428; 118/413, 410, 414, 262, 261, 679, 304, 206, 315, 313, 325, 419

(56) References Cited

U.S. PATENT DOCUMENTS

| | | | | | |
|---|---|---|---|---|---|
| 4,245,582 | A | | 1/1981 | Alheid et al. | 118/119 |
| 4,369,731 | A | | 1/1983 | Damrau | 118/410 |
| 4,702,196 | A | | 10/1987 | Kratzberger | 118/410 |
| 4,757,782 | A | | 7/1988 | Pullinen | 118/411 |
| 4,859,507 | A | | 8/1989 | Damrau | 427/356 |
| 4,880,671 | A | | 11/1989 | Sollinger et al. | 427/356 |
| 4,911,097 | A | * | 3/1990 | Fundell | 118/413 |
| 4,945,855 | A | * | 8/1990 | Eklund et al. | 118/413 |
| 4,963,397 | A | | 10/1990 | Mayer et al. | 427/356 |
| 4,964,364 | A | * | 10/1990 | Karna et al. | 118/410 |
| 5,031,569 | A | | 7/1991 | Eriksson | 118/407 |
| 5,078,081 | A | | 1/1992 | Kustermann | 118/119 |
| 5,328,511 | A | | 7/1994 | Beisswanger | 118/203 |
| 5,376,177 | A | | 12/1994 | Elvidge et al. | 118/410 |
| 5,529,629 | A | | 6/1996 | Beisswanger | 118/665 |
| 5,538,555 | A | | 7/1996 | Wille et al. | 118/261 |
| 5,611,860 | A | | 3/1997 | Waech | 118/410 |
| 5,788,771 | A | * | 8/1998 | Madrzak et al. | 118/414 |

FOREIGN PATENT DOCUMENTS

| | | | | |
|---|---|---|---|---|
| DE | 31 20716 A1 | | 9/1982 | B05C/5/02 |
| DE | 37 34 900 A1 | | 12/1988 | B05C/11/02 |
| DE | 42 03 398 A1 | | 8/1992 | D21H/23/32 |
| DE | 41 31 849 C1 | | 1/1993 | B05D/1/26 |
| DE | 41 35 195 A1 | | 4/1993 | B05C/5/02 |
| DE | 42 17 528 A1 | | 12/1993 | B05C/5/02 |
| DE | 43 41 341 C1 | | 3/1995 | B05C/11/02 |
| DE | 44 01 365 A1 | | 7/1995 | B41F/31/06 |
| DE | 195 32 388 C1 | | 12/1996 | B05C/1/08 |
| DE | 44 44 034 C2 | | 7/1997 | B41F/9/10 |
| EP | 0 289 824 A2 | | 11/1988 | D21H/5/00 |
| EP | 0 319 503 B1 | | 5/1993 | B05D/1/00 |
| GB | 1554336 | * | 10/1976 | 118/259 |
| GB | 2 252 926 A | | 8/1992 | B05C/11/04 |
| WO | WO/96/19617 | | 6/1996 | D21H/23/32 |

* cited by examiner

*Primary Examiner*—Brenda A. Lamb
(74) *Attorney, Agent, or Firm*—Taylor & Aust P.C.

(57) ABSTRACT

An apparatus for application of a liquid or pasty coating medium onto a substrate moving past it, for instance a material web of paper, cardboard or boxboard or an applicator roll, includes a back-up chamber which is bounded on its substrate entrance end by a back-up chamber entrance bounding element and on its substrate exit end by a back-up chamber exit bounding element. The apparatus also includes a feed device for feeding the coating medium. In the applicator according to the invention for achieving a uniform coating application, the feed device, viewed in the direction of travel of the substrate, is arranged before the back-up chamber entrance bounding element.

35 Claims, 7 Drawing Sheets

APPARATUS AND METHOD FOR APPLICATION OF A LIQUID OR PASTY MEDIUM ONTO A PASSING SUBSTRATE

BACKGROUND OF THE INVENTION

1. Field of the invention.

The present invention relates to an apparatus for application of a liquid or pasty coating medium onto a substrate moving past it, for example, a material web of paper, cardboard or boxboard or an applicator roll.

2. Description of the related art.

Known as applicators for application of a liquid or pasty coating medium onto a substrate moving past it, for example, are so-called short-dwell applicators. In such short-dwell applicators the coating medium is passed directly into a coating chamber, or back-up chamber, which on its substrate exit end is bounded by a doctor blade or a roll doctor, while on its substrate entrance end it is closed off by a back-up plate or a further doctor blade. Such short-dwell applicators involve various problems which impede achieving a uniform coating on the substrate moving past.

One problem is that the doctor must be uniformly "swept" in order to achieve a uniform coating. That is, the pressure of the approaching coating medium must be so evenly exerted across the entire coating width of the doctor that the doctor lifts off the passing substrate evenly enough to form a clearance of the desired width. In known applicators, however, a sufficiently uniform pressure does not prevail in the coating chamber directly before the doctor. Thus, a relatively great premetering quantity must typically be employed, since otherwise the doctor is unable to guarantee the required minimum coverage of the substrate with coating medium at several spots of the coating width. Another problem is that the uniform coating application on the substrate is hindered by air bubbles which can proceed past the back-up chamber entrance bounding element and into the back-up chamber.

Known from European Patent Document No. EP 0 319 503 B1 is an applicator in which ducts are provided in the back-up chamber entrance bounding element formed by a doctor blade. Through these ducts, the coating medium introduced into the back-up chamber at surplus can exit the back-up chamber in a direction opposite to the direction of travel of the substrate. The exited coating medium collects before the back-up chamber in the area between the substrate and the back-up chamber entrance bounding element, preventing, as a "seal," air bubbles from entering. However, the difficulties discussed in conjunction with the "sweeping" addressed above also occur with the coating apparatus known from European Patent Document No. EP 0 319 503 B1.

SUMMARY OF THE INVENTION

The present invention provides a coating apparatus with which a more uniform coating application can be achieved while at the same time reducing the required premetering quantity. According to the invention, the feed device, viewed in the direction of travel of the substrate, is arranged before the back-up chamber entrance bounding element. With this arrangement of the feed device, the invention finishes "two flies with one swat."

Obtained is an accumulation of coating medium in front of the back-up chamber entrance bounding element, the same as in European Patent Document No. EP 0 319 503 B1, which accumulation seals the back-up chamber against the penetration of air bubbles. Moreover, the inventionally achieved sealing effect considerably surmounts the sealing effect accomplished in European Patent Document No. EP 0 319 503 B1, since this accumulation is formed not only by the surplus coating medium, but also by the entire amount of coating medium fed into the back-up chamber. Also, the back-up chamber entrance bounding element represents a choking point which hinders, to a desired and controlled extent, the entrance of coating medium into the back-up chamber. This choking effect occasions in the coating medium accumulating in front of the back-up chamber an equalization in cross direction, i.e., an equalization over the coating width. Consequently, the coating medium entering the back-up chamber possesses a uniform pressure distribution, and a further equalization of the distribution and of the pressure profile of the coating medium in cross direction occurs in the back-up chamber.

Hence, the coating medium prevails in the inventional coating apparatus across the entire coating width on the back-up chamber exit bounding element, e.g., a doctor element, at substantially equal pressure. Thus, the doctor element is inventionally "swept" highly uniformly. This makes it possible to achieve a uniform coating application on the substrate. Owing to the pressure-equalizing effect of the arrangement according to the invention, a smaller premetering amount as compared to known apparatuses is sufficient to obtain the desired coating application. A further advantage of the inventional coating apparatus is that the option of working with a slight coating medium surplus makes it possible to keep the purchasing and operating costs of the inventional coating apparatus low. For example, the pump capacity required for circulating the coating medium surplus can be kept accordingly low.

The above effect of the inventional coating apparatus allows further improvement by configuring a back-up chamber wall, which connects the back-up chamber entrance bounding element and/or the substrate entrance end and substrate exit end of the back-up chamber with one another, with a view to equalizing the coating medium in cross direction. To that end, the back-up chamber may feature an equalizing section and a coating section bordering on it. The coating section of the back-up chamber ensures that pressure differences still existing in the back-up chamber, e.g., due to swirling or the like, cannot spread up to the immediate vicinity of the doctor.

In the area of the back-up chamber entrance, equalization in cross direction may be aided, e.g., by configuring the back-up chamber entrance bounding element uneven, viewed in the direction of travel of the substrate. For example, the back-up chamber entrance bounding element can be wavy, stepped or with a predetermined roughness in the area of its greatest proximity to the substrate. A diffuser effect occasioned by the unevennesses is utilized in this case. The diffuser effect can be utilized in the area of the back-up chamber by appropriate design of the back-up chamber wall. Besides the options named above, of a wavy, stepped or rough configuration of the back-up chamber wall, consideration may also be given to the installation or attachment of webs, bars or the like in the back-up chamber.

When operating with a coating medium surplus, flow conditions are possible at which the coating medium enters the back-up chamber near the substrate, in the area of the back-up chamber entrance, in an entrance flow oriented in the direction of travel. The coating medium exits the back-up chamber in a surplus flow, away from the substrate, opposite to the direction of travel. Coating medium which enters the back-up chamber at surplus can exit again through at least one backflow duct. The advantage of such backflow ducts is that they produce defined flow conditions in the area of the back-up chamber entrance formed by the back-up chamber entrance bounding element. The backflow ducts may be, e.g., separate lines or channels traversing the doctor bed. Moreover, the backflow ducts may allow respective opening and closing, selectively and independently of one another.

The back-up chamber entrance bounding element may be, e.g., an element integral with a mounting of the back-up chamber exit bounding element. But it is also possible to have the back-up chamber entrance bounding element form an element which is separate from the mounting of the back-up chamber exit bounding element. The former embodiment variant is distinguished by a simple and robust structure, while the latter variant offers the option of choosing the back-up chamber entrance bounding element in contingence on the properties of the relevant coating medium and on other operating parameters of the coating apparatus, notably the speed of travel of the substrate. Employed as separate back-up chamber exit bounding elements, in particular, are doctor blades, wherein consideration may be given to a configuration such as a drag blade as well as a scraper blade. Scraper blades are forced onto the substrate by the approaching coating medium, since they are oriented opposite to the travel direction of the substrate and rest on it. Such scraper blades may feature at least one entrance duct, possibly near the substrate. In both cases, the above-mentioned backflow ducts may be easily formed by holes made in the blade elements.

Independent of the integral or separate configuration of the back-up chamber entrance bounding element addressed above, the element may feature a channeling surface for the coating medium applied onto the substrate by the feed device and entering the back-up chamber. The channeling, or hopper, surface allows improving the desired pressure equalization in cross direction and safeguarding an orderly entrance of the coating medium into the back-up chamber.

One fluidic influencing of the coating medium which enters or has entered the back-up chamber can be obtained, e.g., by configuring the cavity bounded by the substrate and the channeling surface and/or the back-up chamber wall with a cross section in the fashion of a venturi nozzle.

An edge of the back-up chamber entrance bounding element adjacent to the substrate, viewed in cross direction, may extend, e.g., rectilinearly. The edge may also feature sections jutting out toward the substrate and sections recessed relative to the substrate. An edge of the back-up chamber entrance bounding element adjacent to the substrate may also have at least one entrance duct. Such irregularities and ducts guarantee a desired minimum entrance cross section for the coating medium in the back-up chamber. The latter configuration, moreover, also enables a deliberate de-equalization of the coating medium in cross direction, which results in a corresponding de-equalization of the coating. For example, the edge may be wavy, sawtooth-like, stepped or the like.

The back-up chamber entrance bounding element may be joined fixedly to the mounting of the back-up chamber exit bounding element. It is also possible to arrange the back-up chamber entrance bounding element on the mounting of the back-up chamber exit bounding element in a fashion allowing displacement in relation to it. Further, it is possible to connect the back-up chamber entrance bounding element to the mounting of the back-up chamber exit bounding element by way of a web section which allows a limited tilt movement of the back-up chamber entrance bounding element in relation to the mounting. All of these embodiment variants allow a specific influencing of the back-up chamber, irrespective of the relevant setting of the back-up chamber exit bounding element against the substrate. In the case of the former embodiment variant, the influencing may take place, e.g., by varying the relative orientation of mounting and substrate. In the case of the second and third embodiment variants, a relative movement of the back-up chamber entrance bounding element relative to the mounting may be additionally utilized for influencing the back-up chamber.

Using an actuator device for altering the setting of the back-up chamber exit bounding element against the substrate, e.g., the desired coating clearance size may be preset. Using an actuator device for altering the setting of the back-up chamber entrance bounding element against the substrate, the size of the entrance opening to the back-up chamber and/or the size and shape of the back-up chamber may be influenced. Each of the above actuator devices may include a plurality of actuator units distributed across the substrate width and allowing actuation independently of one another. Thus, a profiling of the back-up chamber entrance opening and/or a profiling of size and shape of the back-up chamber can be accomplished over the width of the coating apparatus, that is, in cross direction.

To achieve a desired coating profile, the pressure cross profile forming before the doctor is significant. To adjust a desired pressure cross profile, the volume of the back-up chamber in cross direction may be profiled. With a constant back-up chamber volume, alternatively, the shape of the back-up chamber cross section in cross direction may be profiled. Also, the cross sections of a plurality of backflow ducts provided side by side in cross direction may be chosen independently of one another to achieve a desired pressure cross profile.

The actuator units may be actuated electrically, hydraulically, pneumatically, hydropneumatically and/or manually. For example, at least part of the actuator units may be formed by adjusting screws. Additionally or alternatively, at least part of the actuator units may be formed by pressure hose units. It is also possible for the actuating system to include a pressure hose subdivided in a plurality of chambers. Remote-controlled actuator units or remote-controlled actuator systems can be incorporated readily in the coating control loop. Furthermore, the adjusting force, or adjusting intensity of the actuator system(s) and/or actuator unit(s) may be controllable or regulatable.

As follows from the preceding discussion, the entrance opening to the back-up chamber, formed by the cooperation of back-up chamber entrance bounding element and substrate, exerts a certain choking effect on the coating medium. The effect results in a premetering of the coating medium. A still finer premetering can be achieved, e.g., with a feed device featuring a plurality of feed elements distributed over the width of the substrate. The rates of coating medium application of these feed elements can be adjustable independently of one another, which is notable in view of achieving a coating profile varying in cross direction.

The invention also relates to a method for the application of a liquid or pasty coating medium onto a traveling substrate, for example, a material web of paper, cardboard or boxboard or an applicator roll. With respect to the advantages achievable with this method, reference is made to the preceding discussion of the inventional coating apparatus.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
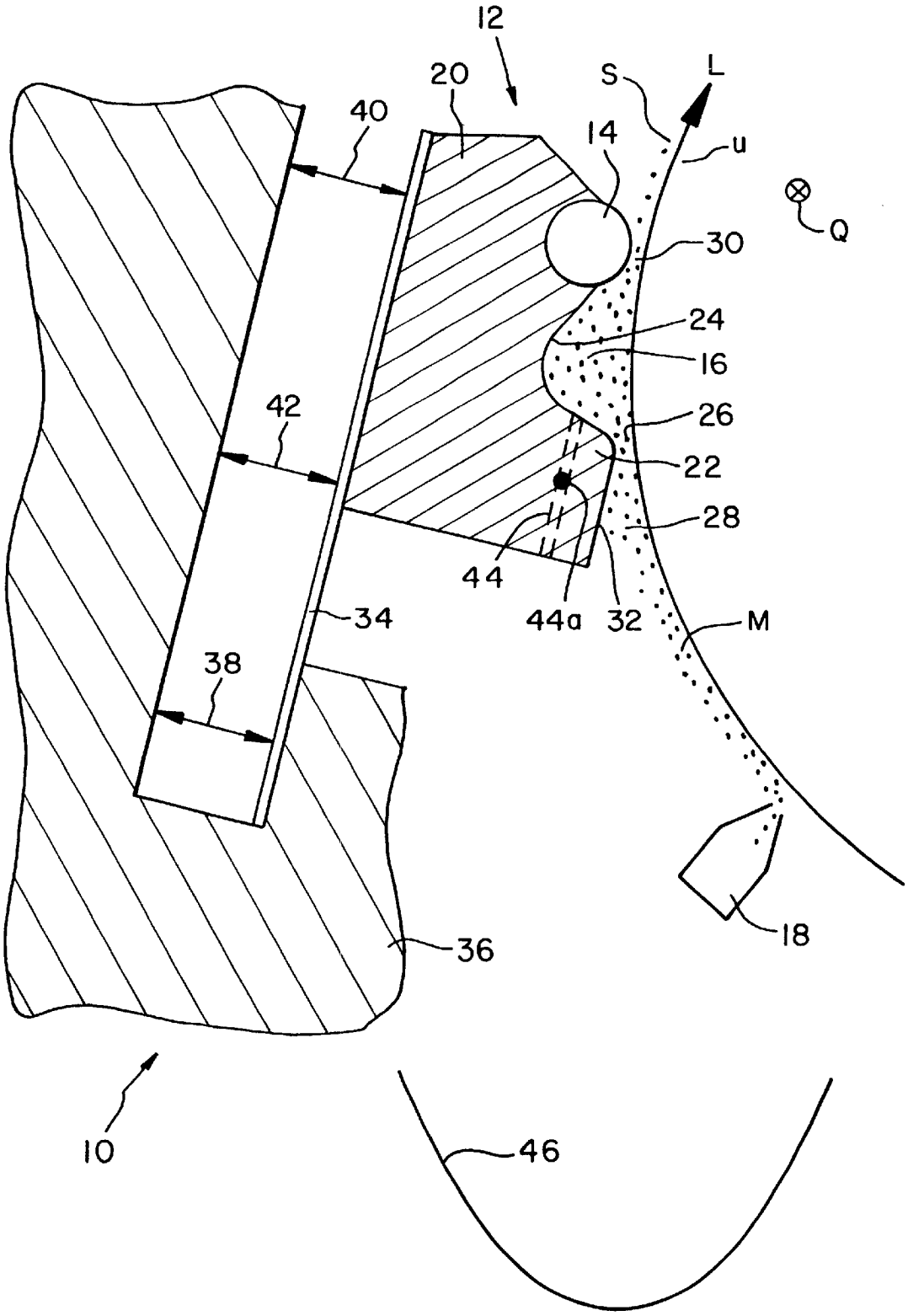
FIG. 1 is a partially sectional, schematic, side elevational view of one embodiment of a coating apparatus of the present invention.

Referring now to the drawings, and particularly to FIG. 1, there is shown a coating apparatus 10 according to the invention. Coating apparatus 10 serves the application of a uniform layer S of a liquid or pasty coating medium M onto a substrate U moving past coating apparatus 10. Substrate U may be in the form, e.g., of an applicator roll; but layer S may also be applied directly onto a material web of paper, cardboard or boxboard moving past coating apparatus 10.

In the illustrated embodiment, coating apparatus 10 includes a doctor device 12 with a roll doctor 14. Coating apparatus 10 also includes a back-up chamber 16 and a feed device 18, by use of which coating medium M is applied onto substrate U in a rough distribution. Roll doctor 14 mounted in a doctor bed 20, has a conventional structure and, therefore, is not described in detail hereinafter. Substrate U moves past coating apparatus 10 in the direction of travel indicated by arrow L. Back-up chamber 16 is on its exit end bounded by doctor element 14 serving as back-up chamber exit bounding element, while on its entrance end it is closed off by a back-up chamber entrance bounding element 22. Moreover, back-up chamber 16 is bounded by substrate U and a back-up chamber wall 24 interconnecting back-up chamber entrance bounding element 22 and doctor 14.

Coating medium M is applied by feed device 18 onto substrate U in direction of travel L and before back-up chamber entrance 26, albeit with an as yet disuniform layer structure, as indicated in FIG. 1 by the irregular stipples. Moving with substrate U, coating medium M proceeds in the area of entrance clearance 26. Coating medium M accumulates in front of clearance 26 on account of the choking effect of clearance 26. An accumulation 28 of coating medium M seals back-up chamber 16 on its entrance end against undesirable access of air. The hydrodynamic flow pressure of coating medium M in front of entrance clearance 26 widens clearance 26 and makes it possible for coating medium M to proceed into back-up chamber 16. Lastly, coating medium M exits from back-up chamber 16 through an exit clearance 30 existing between substrate U and roll doctor 14. Coating medium M proceeds as a uniform coating layer S onto substrate U due to the effect of coating apparatus 10, notably of back-up chamber entrance bounding element 22, of back-up chamber 16 and doctor device 12.

The uniformity of layer S applied with apparatus 10 is based primarily on the fact that the coating medium M prevailing at roll doctor 14 has a uniform distribution and a uniform pressure profile in cross direction Q, that is, in a direction substantially perpendicular to the drawing plane of FIG. 1. This uniform profile is based, for one, on the choking effect of back-up chamber entrance bounding element 22, due to which effect an equalization in cross direction Q comes about in coating medium accumulation 28. The uniform profile is also based on the effect of back-up chamber 16, which results in a further equalization in cross direction Q.

The cross equalization in coating medium M can be influenced by the design of back-up chamber wall 24, of back-up chamber entrance bounding element 22, notably of entrance clearance 26, and by the design of a channeling surface 32. Originating from back-up chamber entrance bounding element 22, channeling surface 32 extends in a direction opposite to direction of travel L of substrate U. Especially favorable hydrodynamic conditions in coating medium accumulation 28 can be achieved with a substrate U and channeling surface 32 forming a cross section substantially in the fashion of a venturi nozzle.

In the embodiment illustrated in FIG. 1, back-up chamber entrance bounding element 22 is integral with doctor bed 20. Doctor bed 20 attaches to doctor beam 36 via a leaf spring 34 clamped by use of an actuator device 38 to doctor beam 36. Actuator device 38 is indicated in a rough, schematic fashion in FIG. 1 by a double arrow and may be formed, for example, by a pressure hose.

Figure 12A:
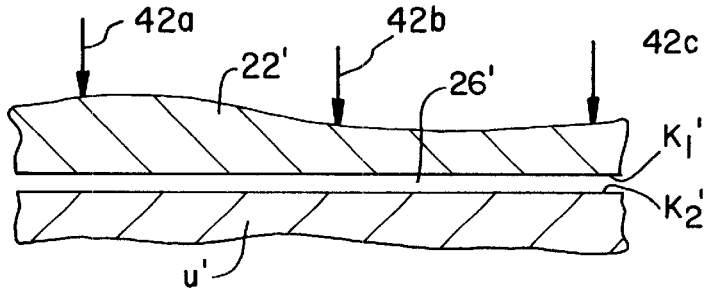
FIG. 12*a* is a fragmentary, sectional view taken along the direction of substrate travel of one embodiment of the edge design between the back-up chamber entrance bounding element and the substrate of FIG. 2.

To allow adjusting the width of the exit or coating clearance 30, an actuator device 40 is provided for influencing the setting of doctor element 14 against substrate U. The width adjustment can be for achievement of the desired coating thickness, depending on operating parameters such as viscosity of coating medium M, the speed of travel of substrate U and the like. Lastly, the width of entrance clearance 26 can be adjusted by use of an actuator device 42. Suitable for use as actuator devices 40 and 42 are, for example, manually actuated adjusting screws, actuator drives actuated by electric motor, and hydraulically, pneumatically or hydropneumatically actuated actuator units, for example pressure hoses. To achieve a more precise influencing of the applied coating and a desired profiling of it, actuator devices 40 and/or 42 are subdivided in cross direction Q in a plurality of sections which are both independent of one another and which allow adjustment or activation of their adjusting force or adjusting intensity. This is indicated in FIG. 12*a* by the actuator units 42*a*, 42*b* and 42*c*. When using remote-controlled actuating devices or units, it is possible to incorporate them in the control loop of the entire coating apparatus 10.

Although FIG. 1, as well as the further embodiments according to FIGS. 2 through 10, depict doctor devices with a roll doctor 14, other doctor or equalizing elements may be used. For example, doctor blades, air brushes or the like may be used. Nor are any limits set to the design of the roll doctor surface. Furthermore, it is to be understood that roll doctor 14 may be driven rotationally in a direction of rotation equal or opposite to the direction of travel of substrate U.

Any type of feed device may be used. In view of the profiling of the applied coating addressed above, however, feed device 18 can be subdivided in several feed sections arranged side by side in cross direction Q. These feed sections apply coating medium M onto the substrate U at differing feed rates corresponding to the desired coating profile. To that end, feed device 18 may include, e.g., a plurality of applicator nozzles distributed across the coating width, the coating medium throughput being separately adjustable for each of these applicator nozzles.

The amount of coating medium M applied by feed device 18 onto substrate U can be precisely metered according to the desired coating layer S. But it is also possible to apply coating medium M at surplus onto substrate U. In this case it is possible to provide backflow ducts 44 (shown dashed in FIG. 1) originating from back-up chamber 16, through which coating medium M introduced in back-up chamber 16 at surplus can exit from backup chamber 16. The passage cross section of backflow ducts 44 can be adjusted by use of valves 44a to a desired value, including complete opening and complete closing. The surplus coating medium M exiting from backflow ducts 44 can be collected with the aid of a collection trough 46 and recycled to the coating process.

The equalization of coating medium M, or of the pressure prevailing in it, can be influenced by the design of back-up chamber 16, notably of its back-up chamber wall 24. The equalization of coating medium M, or of the pressure prevailing in it, can also be adjusted by influencing the setting of back-up chamber entrance bounding element 22 against substrate U in contingence with operating parameters such as viscosity of coating medium M, speed of travel of substrate U, and the like. Therefore, various design options for back-up chamber 16 and back-up chamber wall 24 will be discussed with reference to FIGS. 2 through 10.

Figure 2:
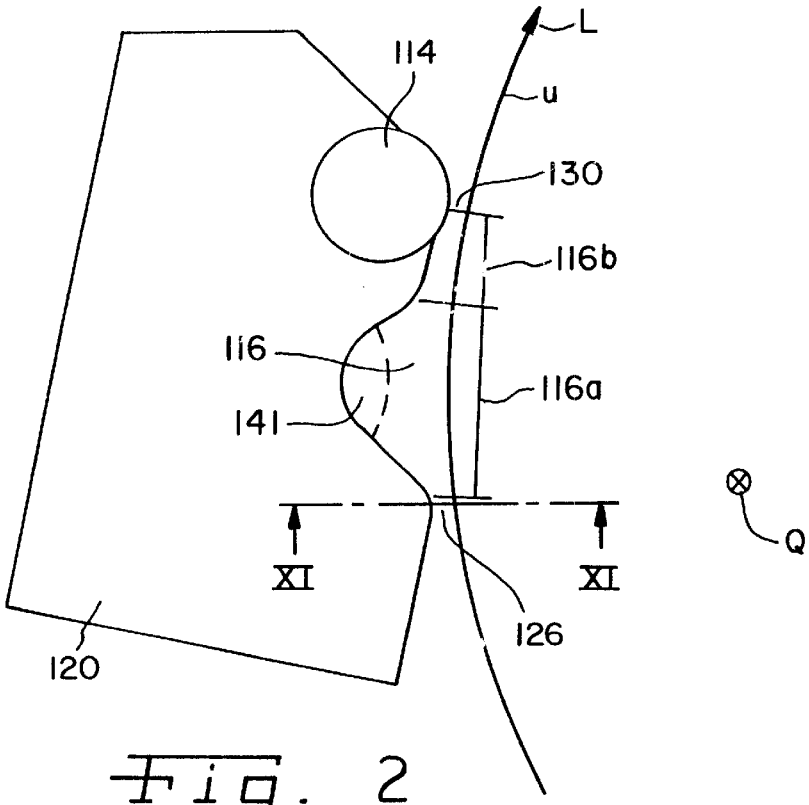
FIG. 2 is a schematic, side elevational view of the essential elements of a second embodiment of a coating apparatus of the present invention.

In the embodiment according to FIG. 2, a back-up chamber 116 has an equalizing section 116*a* bordering on entrance clearance 126, and has a coating section 116*b* bordering on exit clearance 130. The pressure of the coating medium replenishing through entrance clearance 126 adapts in equalizing section 116*a* to the pressure prevailing in back-up chamber 116. Furthermore, an equalization of the pressure profile occurs in cross direction Q and coating medium M has a uniform pressure profile in coating section 116*b*. As a result, the doctor element 114 is accordingly "swept" uniformly and the desired uniform coating is obtained. Also provided is an actuating device 141, for instance an expandable pressure hose, by use of which the shape of back-up chamber 116, for example the cross section of back-up chamber 116 in cross direction Q, can be altered.

Figure 3:
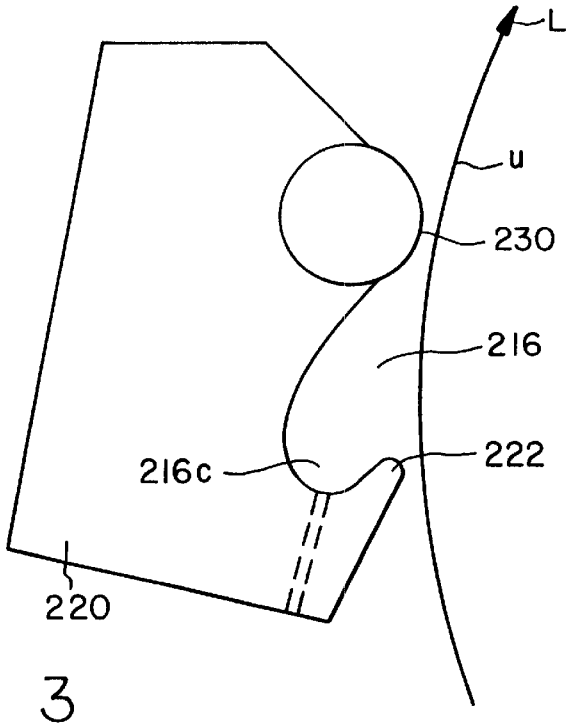
FIG. 3 is a schematic, side elevational view of a third embodiment of a coating apparatus of the present invention.

In the embodiment according to FIG. 3, a back-up chamber 216 includes a section 216*c* relieving back-up chamber entrance bounding element 222 with respect to direction of travel L of substrate U. Such relief section 216*c* is particularly useful in view of an always complete filling of back-up chamber 216.

Figure 4:
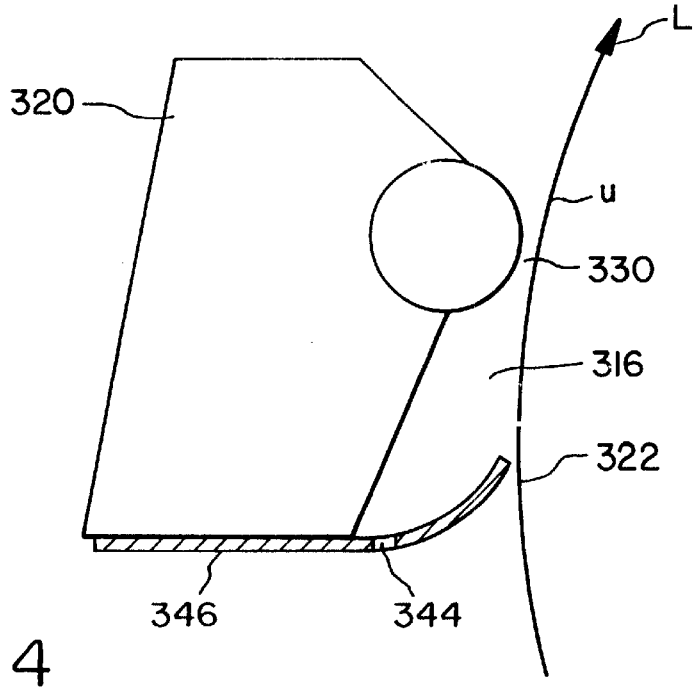
FIG. 4 is a schematic, side elevational view of a fourth embodiment of a coating apparatus of the present invention.

In the embodiment according to FIG. 4, a back-up chamber 316 is bounded by doctor bed 320 and by a blade 346 attached to doctor bed 320. The free end of blade 346 forms back-up chamber entrance bounding element 322 and points in direction of travel L, i.e., blade 346 is configured as a drag blade. The backflow ducts 344 may be formed by holes made in blade 346.

Figure 5:
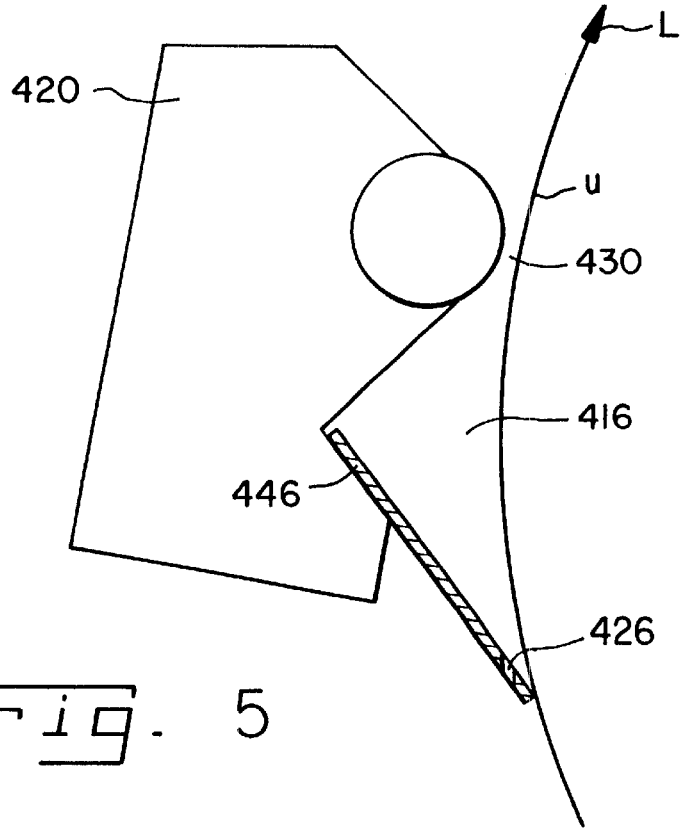
FIG. 5 is a schematic, side elevational view of a fifth embodiment of a coating apparatus of the present invention.

In the embodiment according to FIG. 5, too, a back-up chamber 416 is bounded in part by a blade 446 attached to doctor bed 420. Differing from blade 346, however, blade 446 is configured as a scraper blade, i.e., as a blade oriented against direction of travel L of substrate U. Since such a scraper blade is forced by the hydrodynamic pressure of the supplied coating medium against the surface of substrate U, scraper blade 446 includes perforations assuming the function of an entrance duct or clearance 426.

Figure 6:
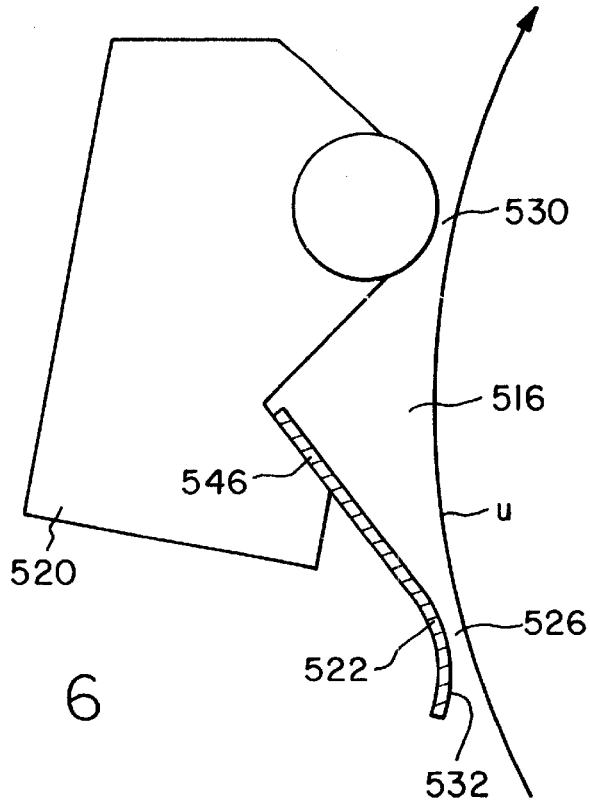
FIG. 6 is a schematic, side elevational view of a sixth embodiment of a coating apparatus of the present invention.

A scraper blade 546 is also provided in the embodiment according to FIG. 6. In variation from the embodiment according to FIG. 5, however, scraper blade 546 is on its free end configured with a channeling surface 532 for the approaching coating medium M, so that scraper blade 546 lifts away from substrate U due to the hydrodynamic flow pressure of the coating medium, releasing its entrance clearance 526.

Figure 7:
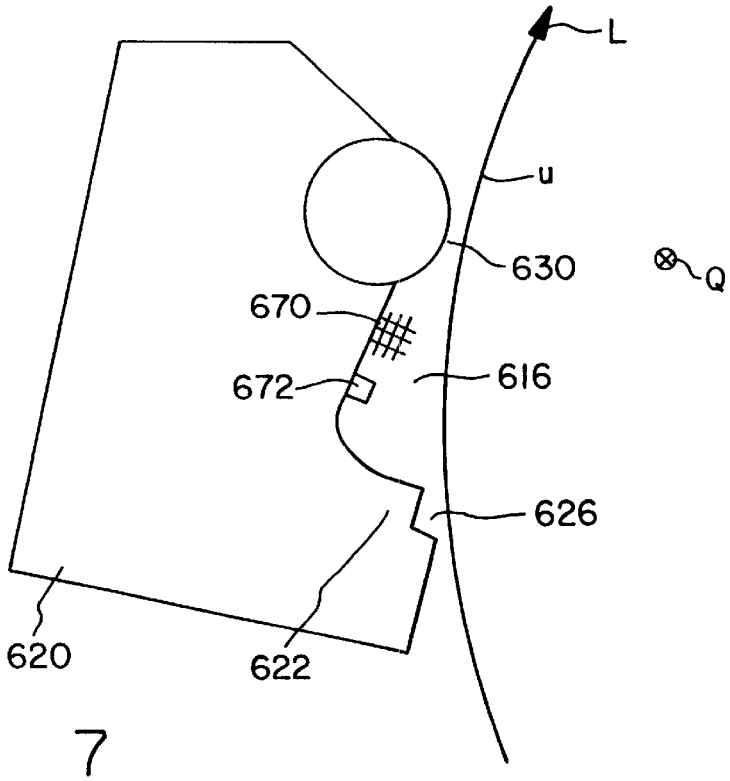
FIG. 7 is a schematic, side elevational view of a seventh embodiment of a coating apparatus of the present invention.

In the embodiment according to FIG. 7, the back-up chamber entrance bounding element 622 bounding the back-up chamber 616 on its entrance end has a stepped configuration in the area of entrance clearance 626, in direction of travel L of substrate U. The stepped-diffuser effect caused by this design of back-up chamber entrance bounding element 622 improves the equalization of the pressure prevailing in coating medium M in cross direction Q. The diffuser effect can also be obtained with other configurations of the back-up chamber entrance bounding element which are deliberately uneven, viewed in the direction of travel of the substrate. Built-ins or add-ons, such as web 670 or bar 672 may be provided in back-up chamber 616.

Figure 8:
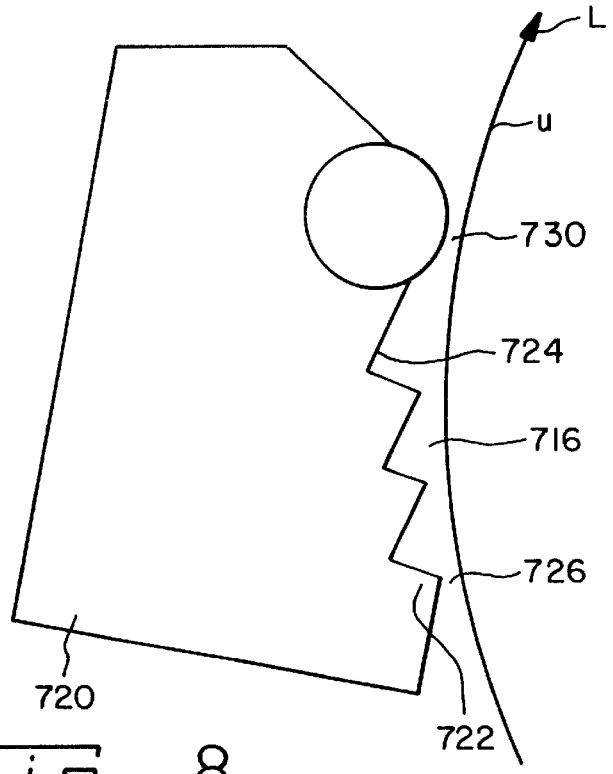
FIG. 8 is a schematic, side elevational view of an eighth embodiment of a coating apparatus of the present invention.

According to FIG. 8, the entire back-up chamber wall 724 of back-up chamber 716 may be stepped in direction of travel L of substrate U.

In the embodiments according to FIGS. 1 through 8 described above, if the size of the exit clearance 30, 130, 230, 330, 430, 530, 630, 730 is kept constant, the size of back-up chamber 16, 116, 216, 316, 416, 516, 616, 716 or the size of the entrance clearance 26, 126, 226, 326, 426, 526, 626, 726 can only be varied by altering the relative orientation of the doctor bed 20, 120, 220, 320, 420, 520, 620, 720 with respect to substrate U. Presented in the following, with reference to FIGS. 9 and 10, are two embodiments in which the back-up chamber entrance bounding element is displaceable relative to the doctor bed.

Figure 9:
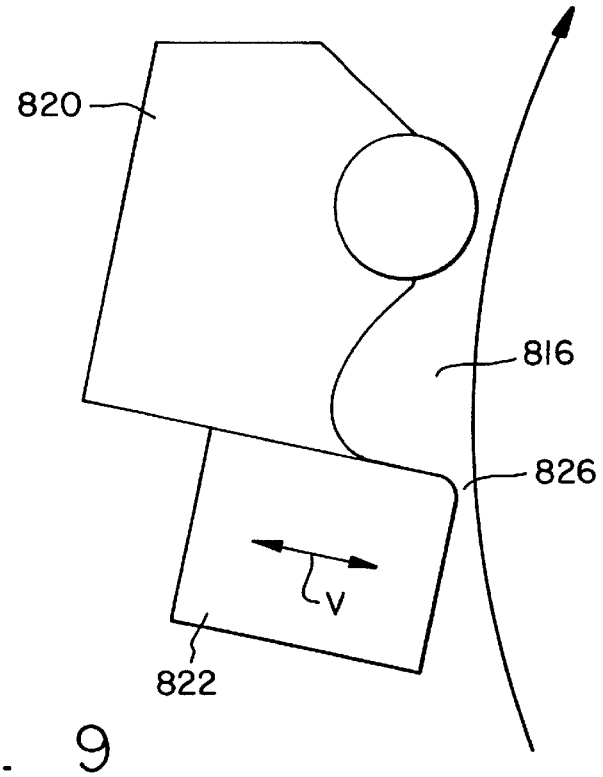
FIG. 9 is a schematic, side elevational view of a ninth embodiment of a coating apparatus of the present invention.

In the embodiment according to FIG. 9, back-up chamber entrance bounding element 822 is attached to doctor bed 820 in a fashion allowing linear displacement in the direction of double arrow V, for example, with the aid of a dovetail or the like. A linear adjustment of back-up chamber entrance bounding element 822 leaves the size of back-up chamber 816 substantially unchanged; only the size of entrance clearance 826 decreases or increases in accordance with this adjustment.

Figure 10:
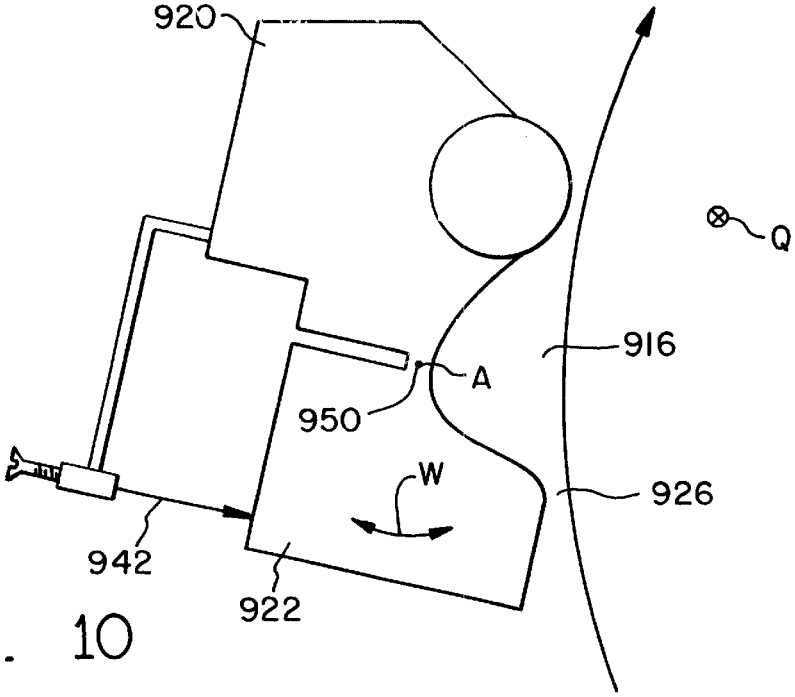
FIG. 10 is a schematic, side elevational view of a tenth embodiment of a coating apparatus of the present invention.

In the embodiment according to FIG. 10, back-up chamber entrance bounding element 922 is integral with doctor bed 920, but it is joined to it only by a relatively weak web 950. The elasticity of web 950 allows a limited tilt of back-up chamber entrance bounding element 922 about an axis A extending in cross direction Q substantially through web 950. In a tilt caused by actuation of the actuating device 942, which is shown in the form of an adjusting screw, both the size of back-up chamber 916 and the width of entrance clearance 926 are altered. Of course, in a modification of the embodiment according to FIG. 10, it is also possible to configure the doctor bed and the back-up chamber entrance bounding element as separate elements which are joined to each other in a manner allowing tilting about axis A.

Figure 11:
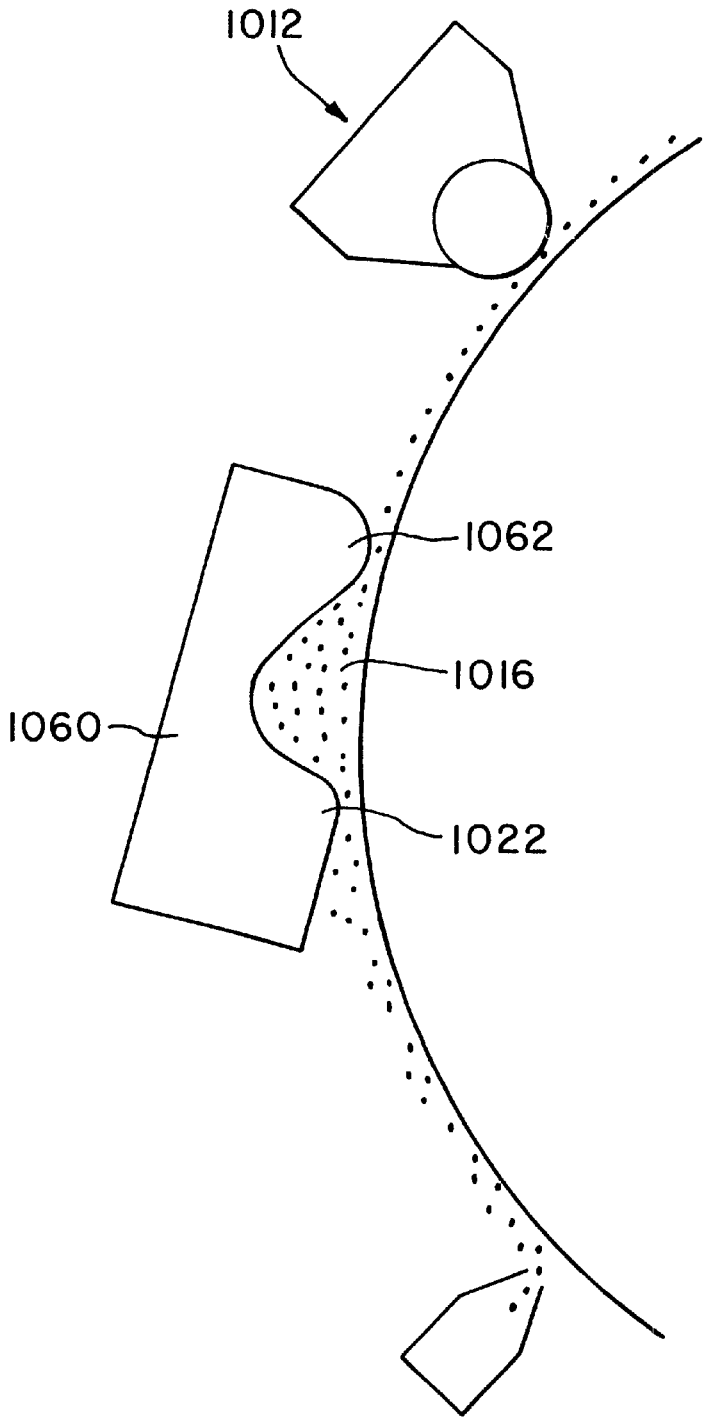
FIG. 11 is a schematic, side elevational view of an eleventh embodiment of a coating apparatus of the present invention.

Although in the embodiments according to FIGS. 1 through 10 the back-up chamber exit bounding element is formed by a doctor element, the invention is not limited thereto. As illustrated in FIG. 11, the metering chamber 1016 may also be provided on a mounting part 1060 which is separate from the doctor device 1012 and arranged separately. Both the back-up chamber entrance bounding element 1022 and the back-up chamber exit bounding element 1062 may be integral with mounting part 1060, as illustrated in FIG. 11, in which case element 1060 does not actually assume a mounting function. With respect to the configuration options of mounting 1060, reference is made to the configuration options described above for the doctor device and, notably, the doctor bed.

Figure 12B:
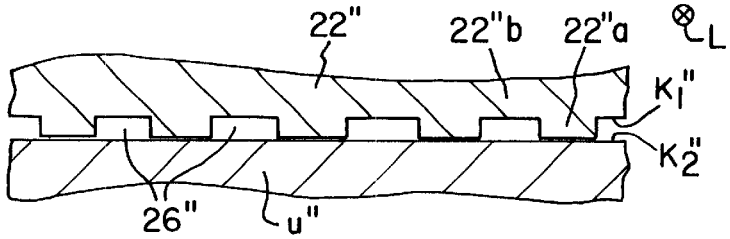
FIG. 12*b* is a fragmentary, sectional view taken along the direction of substrate travel of another embodiment of the edge design between the back-up chamber entrance bounding element and the substrate of FIG. 2.
Figure 12C:
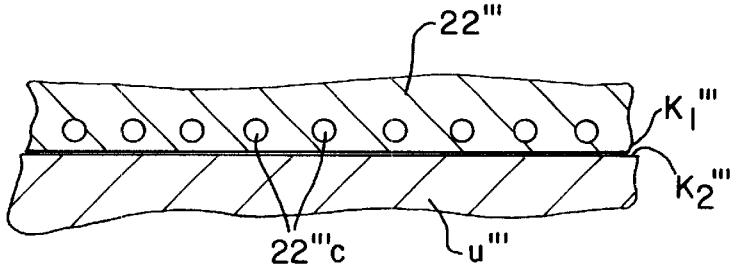
FIG. 12*c* is a fragmentary, sectional view taken along the direction of substrate travel of yet another embodiment of the edge design between the back-up chamber entrance bounding element and the substrate of FIG. 2.

FIG. 12 depicts three variants of configuring the entrance clearance existing between the substrate and the back-up chamber entrance bounding element. In the variant illustrated in FIG. 12*a,* the substrate U' and the back-up chamber entrance bounding element 22' possess edge lines K1' and K2' which extend over cross direction Q rectilinearly throughout. Hence, the entrance clearance 26' may be closed completely in the extreme case. In the variant according to FIG. 12*b,* in contrast, the edge K1" of the back-up chamber entrance bounding element 22" extends steplike with sections 22"*a* protruding toward the substrate U", and with sections 22"*b* recessed with respect to substrate U", while the edge K2" of substrate U" extends rectilinearly. With the protruding sections 22"*a* resting on substrate U", a minimal entrance opening 26" remains between substrate U" and back-up chamber entrance bounding element 22". A minimal entrance opening, according to FIG. 12*c,* can also be obtained with the aid of the perforations 22'"*c* in the area of edge K1'" of the backup chamber entrance bounding element 22'".

Although FIG. 12*b* depicts a stepped pattern of edge line K1", it is understood that any other edge pattern may be provided which safeguards a minimum cross section of the entrance opening. For example, edge K1" could also be wavy, sawtoothed or the like.

It should be noted that the numerous configuration options of the inventional coating device 10 as described above can also be combined with one another to form embodiments which in the preceding have not been described explicitly as embodiment variants of the invention. For example, it is possible to provide the edge variants according to FIG. 12 on drag or scraper blades such as have been described with reference to FIGS. 4, 5, and 6. It is also possible with the blade variants according to FIGS. 4, 5 and 6 to provide backflow ducts which do not extend through the blade body, but through the doctor bed. Moreover, the blades acting as back-up chamber entrance bounding elements may be arranged on the doctor bed, modeled after the embodiments relative to FIGS. 9 and 10, in a manner allowing linear displacement or tilting on the doctor bed. Furthermore, it is also possible to configure the back-up chamber in the embodiments according to FIGS. 3 through 10 in a way modeled after the embodiment according to FIG. 2, with a pressure build-up and equalizing section and a coating section. The inventional coating device can also be employed with a so-called "Speedsizer," belonging to the assignee of the present invention. That is, the inventional coating device can be employed in a system operating with applicator rolls for double-sided coating of a material web.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator for application of a coating medium onto a traveling substrate having a direction of travel and a width, the substrate comprising one of a fiber material web and an applicator roll, said applicator comprising:

a doctor device including a doctor bed, an entrance bounding element and an exit bounding element, each of said entrance bounding element and said exit bounding element being associated with the substrate, said exit bounding element being a doctor element mounted in said doctor bed, said doctor device including a wall between said entrance bounding element and said exit bounding element, said wall defining a back-up chamber, said backup chamber having a shape and a volume defined by said wall, at least one of said entrance bounding element and said wall being configured for substantially equalizing the coating medium across the width of the substrate;

a feed device configured for feeding the coating medium onto the substrate, said feed device being disposed before said entrance bounding element of said doctor device relative to the direction of travel of the substrate; and one of a web and a bar disposed within said back-up chamber.

2. An applicator for application of a coating medium onto a traveling substrate having a direction of travel and a width, the substrate comprising one of a fiber material web and an applicator roll said applicator comprising:

a doctor device including a back-up chamber an entrance bounding element and an exit bounding element each of said back-up chamber, said entrance bounding element and said exit bounding element being associated with the substrate, said back-up chamber being disposed after said entrance bounding element and before said exit bounding element relative to the direction of travel of the substrate, said doctor device including a wall defining said back-up chamber, at least one of said entrance bounding element and said wall being configured for substantially equalizing the coating medium across the width of the substrate; and a feed device configured for feeding the coating medium onto the substrate, said feed device being disposed before said entrance bounding element of said doctor device relative to the direction of travel of the substrate, said entrance bounding element includes a channeling surface configured for receiving the coating medium entering said back-up chamber and applied by said feed device onto the substrate, the substrate and at least one of said channeling surface and said wall defining a cavity having a cross section, said cross section converging in the direction of travel of the substrate.

3. An applicator for application of a coating medium onto a traveling substrate having a direction of travel and a width, the substrate comprising one of a fiber material web and an applicator roll, said applicator comprising:

a doctor device including a back-up chamber, an entrance bounding element and an exit bounding element, each of said back-up chamber, said entrance bounding element and said exit bounding element being associated with the substrate, said back-up chamber being disposed after said entrance bounding element and before said exit bounding element relative to the direction of travel of the substrate, said doctor device including a wall defining said back-up chamber, said backup chamber having a shape and a volume defined by said wall, at least one of said entrance bounding element and said wall being configured for substantially equalizing the coating medium across the width of the substrate;

a feed device configured for feeding the coating medium onto the substrate, said feed device being disposed before said entrance bounding element of said doctor device relative to the direction of travel of the substrate; and an actuator associated with said wall of said doctor device, said actuator being configured for changing said shape of said wall.

4. An applicator for application of a coating medium onto a traveling substrate having a direction of travel and a width, the substrate comprising one of a fiber material web and an applicator roll, said applicator comprising:

a doctor device including a back-up chamber, an entrance bounding element and an exit bounding element, each of said back-up chamber, said entrance bounding element and said exit bounding element being associated with the substrate, said back-up chamber being disposed after said entrance bounding element and before said exit bounding element relative to the direction of travel of the substrate, said doctor device including a single wall defining said back-up chamber, said wall having a shape, said back-up chamber having a volume defined by said shape of said wall, at least one of said entrance bounding element and said wall being configured for substantially equalizing the coating medium across the width of the substrate, said doctor device including at least one backflow duct in fluid communication with said back-up chamber, said at least one backflow duct being configured to allow the coating medium to flow out of said back-up chamber, at least one said backflow duct being selectively variable; and a feed device configured for feeding the coating medium onto the substrate, said feed device being disposed before said entrance bounding element of said doctor device relative to the direction of travel of the substrate.

5. An applicator for application of a coating medium onto a traveling substrate having a direction of travel and a width, the substrate comprising one of a fiber material web and an applicator roll, said applicator comprising:

a doctor device including a back-up chamber having a volume, an entrance bounding element and an exit bounding element, said doctor device including a mounting carrying said exit bounding element, said entrance bounding element being non-monolithic from said mounting, said entrance bounding element comprising one of a drag blade and a scraper blade having at least one entrance duct, each of said back-up chamber, said entrance bounding element and said exit bounding element being associated with the substrate, said back-up chamber being disposed after said entrance bounding element and before said exit bounding element relative to the direction of travel of the substrate, said doctor device including a wall, said wall alone defining at least a portion of said volume of said back-up chamber, at least one of said entrance bounding element and said wall being configured for substantially equalizing the coating medium across the width of the substrate; and a feed device configured for feeding the coating medium onto the substrate, said feed device being disposed before said entrance bounding element of said doctor device relative to the direction of travel of the substrate, said entrance bounding element includes a channeling surface configured for receiving the coating medium entering said back-up chamber and applied by said feed device onto the substrate.

6. The applicator of claim 5, wherein said entrance bounding element comprises a scraper blade having at least one entrance duct.

7. An applicator for application of a coating medium onto a traveling substrate having a direction of travel and a width, the substrate comprising one of a fiber material web and an applicator roll, said applicator comprising:

a doctor device including a back-up chamber, an entrance bounding element and an exit bounding element, said doctor device including a mounting carrying said exit bounding element, said entrance bounding element being non-monolithic from said mounting each of said back-up chamber, said entrance bounding element and said exit bounding element being associated with the substrate, said back-up chamber being disposed after said entrance bounding element and before said exit bounding element relative to the direction of travel of the substrate, said doctor device including a wall defining said back-up chamber, at least one of said entrance bounding element and said wall being configured for substantially equalizing the coating medium across the width of the substrate, said doctor device including a web section interconnecting said mounting and said entrance bounding element, said entrance bounding element being tiltable relative to said mounting; and a feed device configured for feeding the coating medium onto the substrate, said feed device being disposed before said entrance bounding element of said doctor device relative to the direction of travel of the substrate, said entrance bounding element includes a channeling surface configured for receiving the coating medium entering said back-up chamber and applied by said feed device onto the substrate.

8. The applicator of claim 7, wherein said back-up chamber has a volume, said applicator further comprising a first actuator configured for altering said volume of said back-up chamber.

9. An applicator for application of a coating medium onto a traveling substrate having a direction of travel and a width, the substrate comprising one of a fiber material web and an applicator roll, said applicator comprising:

a doctor device including a back-up chamber, an entrance bounding element and an exit bounding element, each of said back-up chamber, said entrance bounding element and said exit bounding element being associated with the substrate, said entrance bounding element including an edge adjacent to the substrate, said edge comprising a plurality of side by side sections extending across the width of the substrate, at least one said section being disposed nearer the substrate than said sections adjacent to said at least one section, said back-up chamber being disposed after said entrance bounding element and before said exit bounding element relative to the direction of travel of the substrate, said doctor device including a wall defining said back-up chamber, said backup chamber having a shape and a volume defined by said wall, at least one of said entrance bounding element and said wall being configured for substantially equalizing the coating medium across the width of the substrate; and a feed device configured for feeding the coating medium onto the substrate, said feed device being disposed before said entrance bounding element of said doctor device relative to the direction of travel of the substrate.

10. An applicator for application of a coating medium onto a traveling substrate having a direction of travel and a width, the substrate comprising one of a fiber material web and an applicator roll, said applicator comprising:

a doctor device including an entrance bounding element and an exit bounding element, said entrance bounding element and said exit bounding element being associated with the substrate, said doctor device including a wall between said entrance bounding element and said exit bounding element, said wall defining a back-up chamber, said backup chamber having a shape and a volume defined by said wall, at least one of said entrance bounding element and said wall being configured for substantially equalizing the coating medium across the width of the substrate.

11. The applicator of claim 10, further comprising an exit bounding element actuator configured for moving said exit bounding element relative to the substrate.

12. The applicator of claim 10 wherein said actuator comprises a plurality of actuator units distributed across the width of the substrate, each of said plurality of actuator units being independently actuatable.

13. The applicator of claim 12, wherein said plurality of actuator units are configured for at least one of electric, hydraulic, pneumatic, hydropneumatic and manual actuation.

14. The applicator of claim 12, wherein at least one of said plurality of actuator units comprises an adjusting screw.

15. The applicator of claim 12, wherein at least one of said plurality of actuator units comprises a pressure hose unit.

16. The applicator of claim 15, wherein said pressure hose unit is subdivided into a plurality of chambers.

17. The applicator of claim 10, wherein said actuator has an actuating force, said actuating force being one of controllable and regulatable.

18. An applicator for application of a coating medium onto a traveling substrate having a direction of travel and a width, the substrate comprising one of a fiber material web and an applicator roll, said applicator comprising:

a doctor device including a doctor bed, an entrance bounding element and an exit bounding element, each of said entrance bounding element and said exit bounding element being associated with the substrate, said exit bounding element being a doctor element mounted in said doctor bed, said doctor device including a wall between said entrance bounding element and said exit bounding element, said wall defining a back-up chamber, said backup chamber having a shape and a volume defined by said wall, at least one of said entrance bounding element and said wall being configured for substantially equalizing the coating medium across the width of the substrate; and a feed device configured for feeding the coating medium onto the substrate, said feed device being disposed before said entrance bounding element of said doctor device relative to the direction of travel of the substrate, said feed device including a plurality of feed elements distributed across the width of the substrate, each of said feed elements has a throughout of the coating medium and the throughout is adjustable.

19. The applicator of claim 18, wherein said back-up chamber includes an equalizing section disposed adjacent a coating section.

20. The applicator of claim 18, wherein said entrance bounding element is substantially uneven as viewed in the direction of travel of the substrate.

21. The applicator of claim 20, wherein said entrance bounding element is one of wavy, stepped, and of a predetermined roughness.

22. The applicator of claim 18, wherein said entrance bounding element has an area nearest the substrate, said area being substantially uneven as viewed in the direction of travel of the substrate.

23. The applicator of claim 18, wherein said entrance bounding element includes a channeling surface configured for receiving the coating medium entering said back-up chamber and applied by said feed device onto the substrate.

24. The applicator of claim 18, wherein said doctor device includes at least one backflow duct in fluid communication with said back-up chamber, said at least one backflow duct being configured to allow the coating medium to flow out of said back-up chamber.

25. The applicator of claim 18, wherein said doctor device includes a mounting carrying said entrance bounding element.

26. The applicator of claim 25, wherein said entrance bounding element is integral with said mounting.

27. The applicator of claim 25, wherein said entrance bounding element is fixedly joined to said mounting.

28. The applicator of claim 25, wherein said entrance bounding element is connected to said mounting, said entrance bounding element being movable relative to said mounting.

29. The applicator of claim 18, wherein said entrance bounding element includes an edge adjacent to the substrate, said edge extending rectilinearly across the width of the substrate.

30. The applicator of claim 18, wherein said entrance bounding element includes an edge adjacent to the substrate, said edge having at least one entrance duct.

31. The applicator of claim 18, wherein each said throughput being independently adjustable.

32. A method for application of a coating medium onto a traveling substrate having a direction of travel, the substrate comprising one of a fiber material web and an applicator roll, said method comprising the steps of:

providing a doctor device including a wall, an entrance bounding element and an exit bounding element, at least one of said entrance bounding element and said wall being configured for substantially equalizing the coating medium across the width of the substrate, said wall defining a back-up chamber, each of said back-up chamber, said entrance bounding element and said exit bounding element being associated with the substrate, said back-up chamber being disposed after said entrance bounding element and before said exit bounding element relative to the direction of travel of the substrate, said entrance bounding element defining a sole entrance for the coating medium into said back-up chamber, said back-up chamber having a volume and a shape;

feeding the coating medium into said back-up chamber by using a feed device having a feed rate to apply the coating medium onto the substrate at a location disposed before said entrance bounding element relative to the direction of travel of the substrate; and making at least one adjustment via at least one actuator, dependent upon qualities of the coating application on the substrate, each said adjustment being one of:

adjusting a distance between said entrance bounding element and the substrate;

changing said volume of said back-up chamber; and altering said shape of said back-up chamber.

33. The method of claim 32, wherein said doctor device has a width substantially orthogonal to the direction of travel of the substrate, said method comprising the further steps of:

dividing each of said doctor device and said feed device into a plurality of adjusting sections disposed side by side across the width of said doctor device; and making said adjustments mutually independently in said plurality of adjusting sections.

34. An applicator for application of a coating medium onto a traveling substrate having a direction of travel and a width, the substrate comprising one of a fiber material web and an applicator roll, said applicator comprising:

a doctor device including a back-up chamber having a volume, an entrance bounding element and an exit bounding element, said doctor device including a mounting carrying said exit bounding element, said entrance bounding element being non-monolithic from said mounting, each of said back-up chamber, said entrance bounding element and said exit bounding element being associated with the substrate, said back-up chamber being disposed after said entrance bounding element and before said exit bounding element relative to the direction of travel of the substrate, said doctor device including a wall, said wall alone defining at least a portion of said volume of said back-up chamber, at least one of said entrance bounding element and said wall being configured for substantially equalizing the coating medium across the width of the substrate, an entrance clearance being disposed between said entrance bounding element and the substrate, said entrance bounding element being slidable relative to said mounting to selectively adjust said entrance clearance; and a feed device configured for feeding the coating medium onto the substrate, said feed device being disposed before said entrance bounding element of said doctor device relative to the direction of travel of the substrate, said entrance bounding element includes a channeling surface configured for receiving the coating medium entering said back-up chamber and applied by said feed device onto the substrate.

35. An applicator for application of a coating medium onto a traveling substrate having a direction of travel and a width, the substrate comprising one of a fiber material web and an applicator roll, said applicator comprising:

a doctor device including a back-up chamber, an entrance bounding element and an exit bounding element, each of said back-up chamber, said entrance bounding element and said exit bounding element being associated with the substrate, said doctor device including a mounting carrying said exit bounding element, said entrance bounding element being pivotable about an axis relative to said mounting, said back-up chamber being disposed after said entrance bounding element and before said exit bounding element relative to the direction of travel of the substrate, said doctor device including a single wall defining said back-up chamber, said wall having a shape, said back-up chamber having a volume defined by said shape of said wall, at least one of said entrance bounding element and said wall being configured for substantially equalizing the coating medium across the width of the substrate; and a feed device configured for feeding the coating medium onto the substrate, said feed device being disposed before said entrance bounding element of said doctor device relative to the direction of travel of the substrate.

* * * * *

UNITED STATES PATENT AND TRADEMARK OFFICE

CERTIFICATE OF CORRECTION

PATENT NO. : 6,468,588 B1
DATED : October 22, 2002
INVENTOR(S) : Richard Bernert et al.

It is certified that error appears in the above-identified patent and that said Letters Patent is hereby corrected as shown below:

Title page,
Item [30], Foreign Application Priority Data, please insert -- DE 197 23 458.5, Filed June 4, 1997 -- therefor.

Item [56], References Cited, U.S PATENT DOCUMENTS, please add
-- 4,387,663 6/1983 Alheid 118/413
4,839,201 6/1989 Rantanen et al. 118/413
5,885,350 3/1999 Henninger 118/413 -- therefor.

FOREIGN PATENT DOCUMENTS, please add -- WO WO/90/06184 6/1990 -- therefor.

Column 13,
Line 42, after "substrate" delete "." and add -- ; and an actuator configured for moving said entrance bounding element relative to the substrate -- therefor.

Column 14,
Line 18, after "a", delete "throughout" and substiture -- throughput -- therefor.
Line 19, after "the", delete "throughout" and substitute -- throughput -- therefor.

Signed and Sealed this

Thirty-first Day of August, 2004

JON W. DUDAS
*Director of the United States Patent and Trademark Office*